US005348199A

United States Patent [19]

Smith

[11] Patent Number: 5,348,199

[45] Date of Patent: Sep. 20, 1994

[54] AEROSOL VALVE HAVING MEANS TO SHUT OFF FLOW IF VALVE IS TIPPED BEYOND A CERTAIN INCLINATION FROM VERTICAL

[75] Inventor: Jeremy P. Smith, Louden, N.H.

[73] Assignee: Summit Packaging Systems, Inc., Manchester, N.H.

[21] Appl. No.: 119,623

[22] Filed: Sep. 13, 1993

[51] Int. Cl.[5] ..... B65D 83/00

[52] U.S. Cl. ..... 222/402.19; 222/402.1

[58] Field of Search ..... 222/321, 341, 376, 402.1, 222/402.11, 402.16, 402.19, 464, 481, 500; 239/570; 137/38

[56] References Cited

U.S. PATENT DOCUMENTS

| | | | |
|---|---|---|---|
| 3,186,605 | 6/1965 | Potoczky | 222/402.11 |
| 4,124,201 | 11/1978 | Spitzer et al. | 222/402.19 |
| 5,186,201 | 2/1993 | Warren | 222/402.19 |

FOREIGN PATENT DOCUMENTS

| | | | |
|---|---|---|---|
| 526298 | 2/1993 | European Pat. Off. | 222/402.11 |

*Primary Examiner*—Andres Kashnikow
*Assistant Examiner*—Philippe Derakshani
*Attorney, Agent, or Firm*—Dallett Hoopes

[57] ABSTRACT

In an aerosol valve the flow path includes a compartment having an inlet into the compartment and a valve seat at the upper end of the compartment, a pocket is disposed downward from the seat opening, the pocket containing a gravity-responsive ball. When the valve is being used in dispensing and is tipped in a direction which brings the ball closer to the flow through the compartment, the ball becomes entrained in the fluid flow and flies up to seat on the valve seat to block it off, precluding further discharge. When the aerosol valve is released, a bypass raises the pressure inside the valve body so that the ball will fall away from the seat. The purpose is to avoid the escape of propellant which might occur in tipping if the lower end of the dip tube is exposed to the head space.

11 Claims, 2 Drawing Sheets

AEROSOL VALVE HAVING MEANS TO SHUT OFF FLOW IF VALVE IS TIPPED BEYOND A CERTAIN INCLINATION FROM VERTICAL

BACKGROUND OF THE INVENTION

1. Field of the Invention

This invention relates to an aerosol valve having means to cut off the discharging flow when the container is tipped.

There has always been a need to cut off discharging flow when an aerosol can is tipped. The need is greater now. With the environmentally mandated prohibition of chloroflorocarbons and hydrocarbons propellants, the aerosol industry bas turned to pressurized gas propellants, especially nitrogen and carbon dioxide. Nitrogen and other pressurized gases, having relatively high vapor pressure, are not as ideal as some chloroflorocarbons or hydrocarbons because they do not change from liquid phase to gaseous phase and permit the pressure to recover as part of the propellant is used up or lost. Nitrogen and carbon dioxide do not go into liquid phase at practical pressures used in aerosol containers.

To permit the tilting of the container during dispensing runs the risk of the bottom of the dip tube being exposed to the head space above the liquid which would let the pressurized gas above the product escape. Any such escape cannot be tolerated a compressed gas system.

2. Description of Related Art including Information Disclosed under §§1.97 to 1.99

While the aerosol valve art is extensive, there is no satisfactory answer to the problem described above.

The U.S. Pat. No. to Braun 3,315,693 which issued Apr. 25, 1967, discloses an attachment structure in which a gravity-responsive ball normally blocks a passage in an aerosol valve to the outside of the valve body, but, when the can is inverted, the ball drops to permit passage of the product into the valve body. With the valve body filled with and submerged in product, there is no way for the gas pressure in the head space to escape, and it performs its normal function of pressuring the product out through the valve outlet. This is an example of an "invertible valve".

There are other examples of such structures, one being the U.S. Pat. No. 4,728,692 to Meurescb et al issued Feb. 9, 1988. In this patent a one-piece valve body with conventional appearance from the outside has an inside chamber for a ball-operated valve also accessible to the outside of the valve body for when the aerosol can is inverted. The operation is the same as in the Braun structure.

In U.S. Pat. No. 2,954,904 which issued Oct. 4, 1960 to Potoczky an overcap is provided which connects to the aerosol valve stem by way of a flexible diaphragm under a flexible top panel of the cap. A ball is disposed between the diaphragm and the top panel, both the diaphragm and top panel being downwardly inclined toward their centers. In normal vertical disposition of the can, the ball rolls toward the center of the overcam immediately above the stem, and when it is desired to operate the aerosol valve therebelow, below, one merely presses the center of the overcap top panel and the depressing force acts through the ball to depress the center of the diaphragm and the valve stem. Such an arrangement is fine for assuring that the can be vertical when the aerosol is operated. However, it does not serve to function as a cut-off if the operation is commenced while the can is vertical and the can is then tilted to a position, say, where the bottom of the dip tube is exposed to the head space.

Another U.S. Pat. No. 3,186,605 to Potoczky issued Jun. 1, 1965 shows a functionally similar but differently structured arrangement.

SUMMARY OF THE INVENTION

The present invention is concerned with means for cutting off the flow of aerosol whenever the can is tilted to a point at which the bottom of the dip tube is exposed or is in danger of being exposed to the head space.

In the present invention a more or Less standard aerosol valve comprises a cup-shaped body with a valve therein, the body having at its lower end a tubular tailpiece with dip tube attached. This structure constitutes a flow path up the dip tube through the tailpiece into the valve body and out through the valve stem when the stem is depressed. The flow path also includes a compartment having an inlet into the compartment and a valve seat at the upper end of the compartment circumposing an outlet from the compartment. A pocket is disposed downward from the seat opening, the pocket containing a gravity-responsive ball.

In use, when the can is tipped in a direction which brings the ball close to the flow through the compartment and the aerosol valve is turned on, or is already on, the ball becomes entrained in the fluid flow through the inlet and flies up to seat on the valve seat to block it off, precluding further discharge.

The invention also includes means, once the aerosol valve is off, for unseating the ball by raising the pressure inside the valve body when the ball is seated so that ball will fall away from the seat. Such means may be a bypass passage from compartment into valve body. In versions in which the compartment is secured to the lower end of the aerosol valve, the bypass from the compartment into the valve body is blocked when the aerosol valve is depressed.

BRIEF DESCRIPTION OF THE DRAWINGS

Further objects and features of the invention will be apparent from the following specification and a study of the accompanying drawings, all of which disclose nonlimiting embodiments of the invention. In the drawings.

DESCRIPTION OF THE PREFERRED EMBODIMENT

Figure 1:
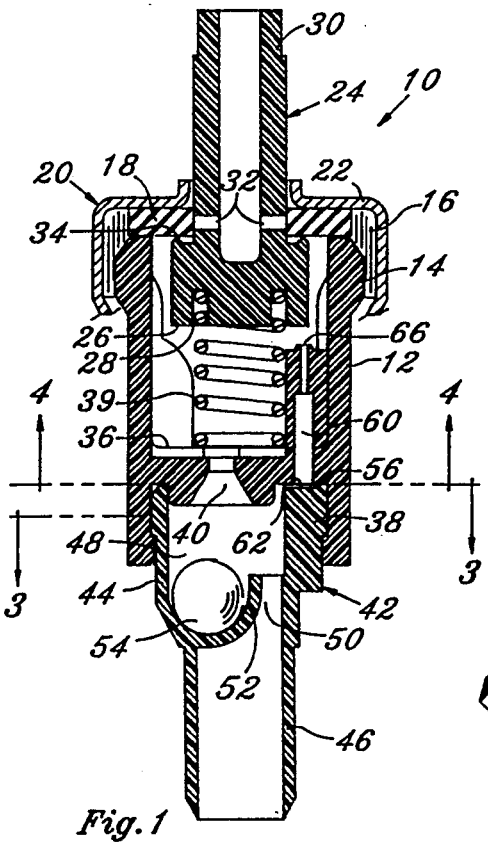
FIG. 1 is a center line section of an aerosol valve embodying the invention.

An aerosol valve embodying the invention is generally designated 10 in FIG. 1. It comprises a cylindrical valve body 12 thickened outwardly at its upper end 14 and having the usual filling castellations 16 outward therefrom. An annular gasket 18 is disposed across the top of the valve body centered by the inner margins of the castellations. The conventional mounting cup pedestal 20 which bas a flat top as at 22 is crimped over the thickened top end 14 to secure the valve body and gasket in place.

A valve element 24 comprising an enlarged bead 26 having an annular opening 28 in the bottom thereof bas an upward tubular stem 30 and generally radial ducts 32 extend outward from the inside of the tubular stem and are closed off by the snug fitting resilient gasket 18.

As shown, the upper end of the bead 26 carries an annular sealing ring or ridge 34 which enrages the underside of the gasket 18 to further seal the unit. The cylindrical valve body 12 has an integral floor 36 and the sidewalls of the body extend down beyond the floor to define an upward socket 38. Centrally the floor 36 is formed with an passage 40 into the valve body. As shown, the passage 40 may be chamfered about its lower end to present a valve seat. A spring 39 is disposed compressively between the floor 36 and the annular recess 28 in the valve element, urging the valve element 24 upward to seat on gasket 18.

An appendage 42 bas a circular side wall 44 which is frictionally held in the socket at the bottom of the valve body and is pressed inward to engage the underside of the floor 36. The sidewall 44 defines therewithin a compartment 48. It comprises, aside from the circular side wall 44, a tailpiece 46 for leading product into the compartment.

As shown, the passage in the tailpiece 46 is narrowed into passage or inlet 50 and extends upward to pass by the outside of a pocket 52 in which is disposed a gravity-responsive ball 54. The upper end of the appendage 42 has an upward sealing rim 56 which in assembly seals against the underside of floor 38.

Figure 2:
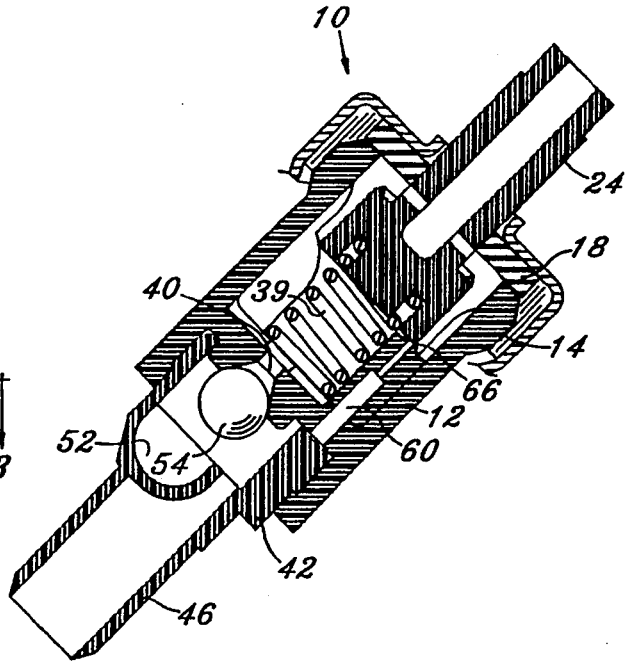
FIG. 2 is a view similar to FIG. 1 but showing the valve tipped and the valve stem depressed as when material is being dispensed, the valve having been tipped beyond the operative range of inclination so that the shut off bas been effected.

FIG. 2 shows the valve of FIG. 1 tipped at an angle of 45°. At this point, with the stem depressed so that the contents of the container can otherwise discharge, the ball 54 moves in its pocket toward the passage 50 such that the ball becomes entrained in the fluid and flies up to seat on the chamfered compartment outlet passage 40, cutting off further flow.

The angle to which the valve must tilt before the ball 54 moves up to block the outlet 40 depends on a number of factors including the flow rate of fluid through the fluid path; the nature of the fluid passing—whether the fluid is a thin liquid such as perfume or a heavier substance, such as furniture polish—and the weight and size of the ball 54. The ball, for instance, may be a steel ball having a diameter of ⅛ inch and a specific gravity of 8 or a plastic ball having a specific gravity of 1.3. The lighter the ball, the quicker it is to fly up and block off the passage 40.

By experimenting with different flow rates of product and different gravity-responsive balls, s ball can be selected to fly up when the tip is the desired angle or, ideally, only after the product has discontinued its movement upward and is followed by the pressurized gas propellant in the bead space. This, of course is desirable in that discharge of the product is the ultimate aim of an aerosol valve and the flow through the valve should only be interrupted when there is actual discharge of gas.

If it is necessary only to assure that no gas discharges, a convenient angle beyond which the container cannot be tipped without having the ball block the inlet 40 is 45°. Product flow, dictated by viscosity, will influence the exact degree at which the valve 10 is tipped prior to valve shutoff.

It will be understood that the shutoff action at the prescribed angle is dependent on the valve and container being tipped in the right direction. This may be assured by the proper orientation of an overcap including an actuator button, the overcap being such that the tendency is to operate with the index finger and tilt the container in the same direction as the index finger points. If the container and valve are tipped in a different direction from that of the FIG. 2 showing, the shutoff will work but at a greater angle of tip than the prescribed angle.

Figure 3:
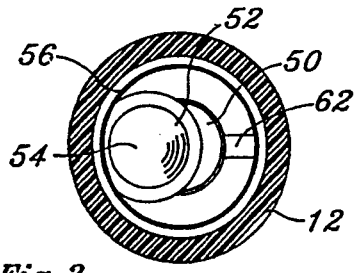
FIG. 3 is a sectional view taken on the line 3—3 of FIG. 1.
Figure 4:
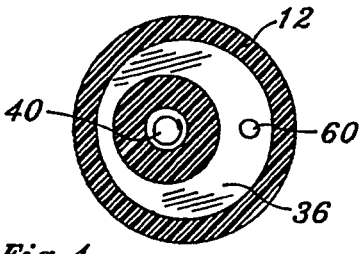
FIG. 4 is a sectional view taken on the line 4—4 of FIG. 1.

Once the ball as described has blocked the outlet passage 40 and the aerosol or main valve is released so that the spring 39 closes the valve, it is necessary to assure that the ball in the compartment 48 moves away from the outlet 40. The ball may stay on the seat because the pressure in the main valve body 12 is lower than the pressure in the compartment 48. FIG. 1 discloses a bypass passage 60 for this purpose. The lower end of the passage 60 communicates with the compartment through a channel 62 formed in the top of the appendage as shown in FIG. 3. The passage 60 is disposed in an inward enlargement 64 of the side wall of the body 12.

The passage 62 is abruptly narrowed in the version shown anti terminates in a circular upward lip 66. When the actuator button is depressed, lip 66 is butted against by the bottom of the flat valve element bead 26. This valves off the passage 60 when the valve element is depressed so that during use all discharge of product comes through the outlet 40. When the valve is allowed to rise, the lip 66 is is exposed, and pressure passes freely from the compartment 48 up into the aerosol valve body, permitting the ball 54 to drop, opening outlet 40.

Figure 5:
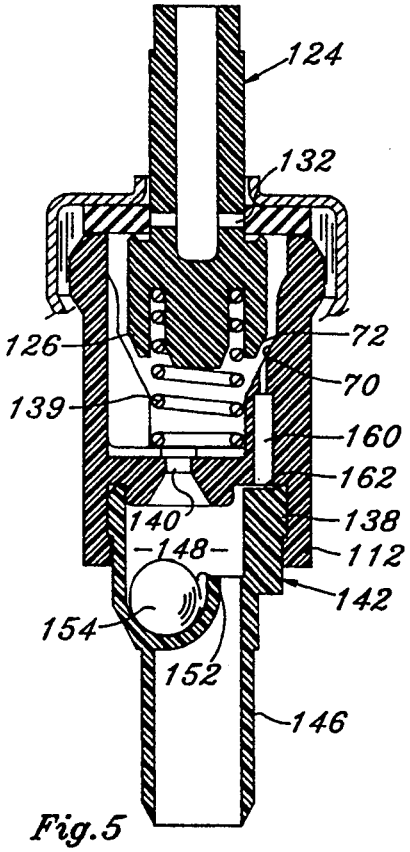
FIG. 5 is a modified version embodying the invention.
Figure 6:
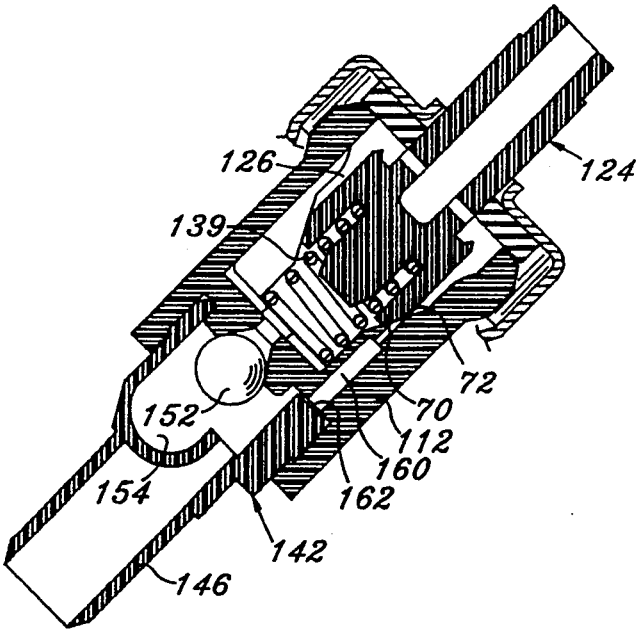
FIG. 6 is a view similar to FIG. 5, but showing the valve tipped beyond the operative range of inclination.

In the FIGS. 5 and 6 embodiment the same reference numerals with 100 added are applied as in the FIGS. 1 through 4 embodiment. In the FIG. 5 embodiment the passage 160 terminates upwardly in an outlet through an upward incline wall 70. The underside of the head 126 of the valve element is chamfered at 72 about its periphery at the same angle as the sloping wall 70 so that as the valve element 126 is depressed, the chamfered section 72 engages the sloping wall 70 and cuts off the upper end of passage 160.

The operation of the FIGS. 5 and 6 embodiment is similar to FIGS. 1 through 4 embodiment in that during operation the passage 160 is closed by the chamfered section of the bead 126 and all flow comes through the compartment outlet 140. If the valve is tipped and the ball 154 seats over outlet 140, the mere release of the valve element permits it to raise, opening the outlet for passage 160 equalizing pressure in the compartment 148 and inside the valve body.

Figure 7:
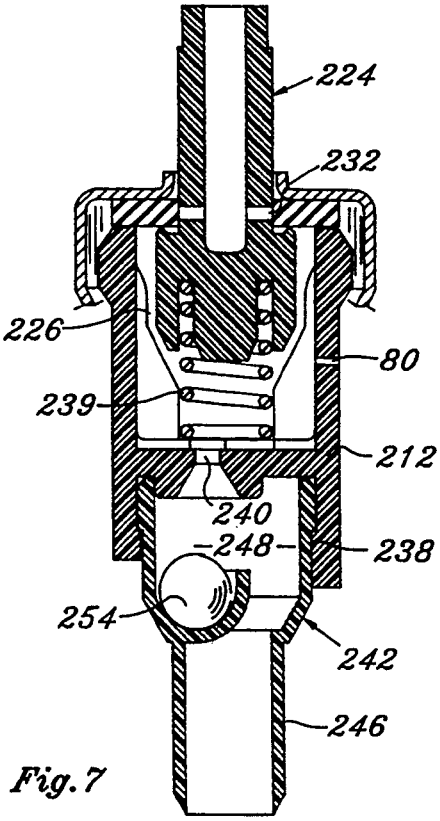
FIG. 7 is a further modified version embodying the invention.
Figure 8:
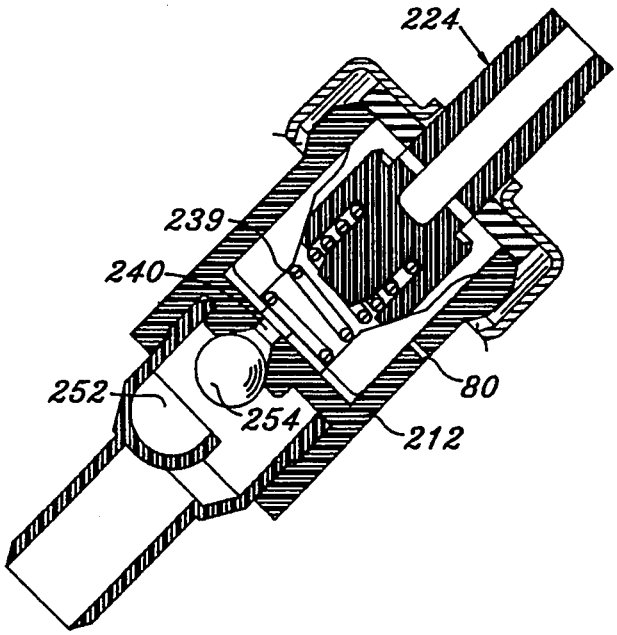
FIG. 8 is a view similar to FIG. 7, but showing the valve tipped beyond the operative range of inclination.

A far simpler arrangement is disclosed in FIGS. 7 and 8 wherein the same reference numerals are used with 200 added. Rather than a bypass down into compartment 48, a minute vapor tap 80 is provided in the side wall of the valve body in FIG. 7. This minute vapor tap (for example 0.004") permits communication between the inside of the valve body 212 and the bead space so that the ball 254 will not be held on the seat 240 by pressure differential after the main valve 224 is released.

It should be understood that the invention is not limited to the embodiments shown, but the invention is instead defined by the scope of the following claim language, expanded by an extension of the right to exclude as is appropriate under the doctrine of equivalents.

What is claimed is:

1. In an aerosol valve comprising:

a. a cup-shaped valve body adapted to be installed facing outward in the mouth of an aerosol can, b. an annular resilient gasket sealingly disposed in the open end of the valve body, c. a valve stem comprising a tubular element snugly disposed in the gasket and having a lateral opening therein normally closed by the gasket and an enlarged head normally disposed against the underside of the gasket, d. spring means compressively disposed between the valve element and the valve body urging the valve element with the enlargement against the underside of the gasket e. a dispensing bead on the valve stem and having a discharge passage therein and an outlet orifice, f. dip tube means operatively connected to the valve body so that the dip tube, the valve body, the lateral openings in the valve stem, the tubular element and the dispensing bead constitute a flow path for the product through the valve, the improvement comprising a flow shutoff compartment fixed in position with respect to the valve body and disposed in the flow and normally permitting flow therethrough, the compartment including a generally vertical passage and a gravity-sensitive element to one side of the vertical passage, the compartment having a first opening in its lower end and an upper generally horizontal wall having a second opening therein, the and second openings comprising elements of the flow path, whereby when the aerosol valve is on and the aerosol valve is tipped beyond a certain angle from the vertical, the blocking element will become entrained in the product flow and move up to block off the second opening to shut off the aerosol valve.

2. An aerosol valve as claimed in claim 1 wherein the compartment includes a pocket, open at the top and the blocking element is a free gravity-responsive ball in the pocket,

3. An aerosol valve as claimed in claim 2 wherein the free ball is made of plastic.

4. An aerosol valve as claimed in claim 1 wherein the compartment is fixedly disposed at the lower end of the valve body.

5. An aerosol valve as claimed in claim 1 wherein the certain angle is 45°.

6. An aerosol valve as claimed in claim 1 wherein the compartment is in the form of an appendage secured onto the lower end of the body.

7. An aerosol valve as claimed in claim 1 wherein the bypass passage is formed in the valve body to equalize pressure between the compartment and the inside of the valve body.

8. An aerosol valve as claimed in claim 7 wherein means are provided to close off the bypass when the valve stem is depressed.

9. An aerosol valve as claimed in claim 8 wherein a portion of the head of the valve stem closes off an end of the bypass passage disposed in a wall section of the side wall of the valve body.

10. An aerosol valve as claimed in claim 9 wherein the portion of the bead and the wall section are inclined.

11. An aerosol valve as claimed in claim 1 wherein a minute vapor tap is formed in the valve body to equalize pressure between the inside of the valve body and the headspace so that the blocking element will drop away from the seat when the product flow stops.

* * * * *

UNITED STATES PATENT AND TRADEMARK OFFICE

CERTIFICATE OF CORRECTION

PATENT NO. : 5,348,199

DATED : Sept. 20, 1994

INVENTOR(S) : Jeremy P. Smith

It is certified that error appears in the above-identified patent and that said Letters Patent is hereby corrected as shown below:

```
                Column 1, line 28, after "tolerated", insert --in--;
          line 46, cancel "Meurescb", insert --Meuresch--;
          line 60, cancel "overcam", insert --overcap--;
          line 62, cancel "below,";
Column 2, line 13, cancel "Less", insert --less--;
Column 3, line 14, cancel "bead", insert --head--;
          line 15, cancel "bas", insert --has--;
          line 19, cancel "bead", insert --head--;
          line 20, cancel "enrages", insert --engages--;
          line 63, cancel "s", insert --a--;
          line 67, cancel "bead", insert --head--;
Column 4, line 35, cancel "anti", insert --and--;
          Line 37, cancel "bead", insert --head--;
          line 57, cancel "bead", insert --head--;
Column 5, line 1,  cancel "bead", insert --head--;
          line 25, cancel "bead", insert --head--;
          line 30, cancel "bead", insert --head--;
          line 31, bring "the improvement" out to left margin;
          line 40, after "the", insert --first--;
Column 6, line 34, cancel "bead", insert --head--.
```

Signed and Sealed this

Eighth Day of November, 1994

*Attest:*

Bruce Lehman

BRUCE LEHMAN

*Attesting Officer*

*Commissioner of Patents and Trademarks*